US007041738B2

(12) United States Patent
Krull et al.

(10) Patent No.: US 7,041,738 B2
(45) Date of Patent: May 9, 2006

(54) COLD FLOW IMPROVERS FOR FUEL OILS OF VEGETABLE OR ANIMAL ORIGIN

(75) Inventors: Matthias Krull, Harxheim (DE); Bettina Siggelkow, Oberhausen (DE); Martina Hess, Muelheim a. d. Ruhr (DE); Ulrike Neuhaus, Oberhausen (DE)

(73) Assignee: Clariant GmbH, Frankfurt (DE)

( * ) Notice: Subject to any disclaimer, the term of this patent is extended or adjusted under 35 U.S.C. 154(b) by 217 days.

(21) Appl. No.: 10/458,961

(22) Filed: Jun. 11, 2003

(65) Prior Publication Data

US 2004/0010072 A1 Jan. 15, 2004

(30) Foreign Application Priority Data

Jul. 9, 2002 (DE) ..... 102 30 771

(51) Int. Cl.
*C08L 23/18* (2006.01)

(52) U.S. Cl. ..... 525/191; 525/222; 525/240; 525/228; 525/229; 525/227; 525/207; 44/393; 44/329; 44/340; 44/360

(58) Field of Classification Search ..... 525/228, 525/229, 227, 222, 207, 191, 240; 44/393, 44/329, 340, 346
See application file for complete search history.

(56) References Cited

U.S. PATENT DOCUMENTS

| | | | | |
|---|---|---|---|---|
| 2,499,365 | A | 3/1950 | DeGroote et al. | 252/338 |
| 3,245,924 | A | 4/1966 | Cox et al. | 260/2.5 |
| 4,211,534 | A | 7/1980 | Feldman | 44/62 |
| 4,652,611 | A | 3/1987 | Kuroda et al. | 525/207 |
| 4,670,516 | A | 6/1987 | Sackmann et al. | 525/327.6 |
| 4,985,048 | A | 1/1991 | Wirtz et al. | 44/394 |
| 5,186,720 | A | 2/1993 | Feustel et al. | 44/351 |
| 5,200,484 | A | 4/1993 | Reimann | 526/331 |
| 5,254,652 | A | 10/1993 | Reimann et al. | 526/331 |
| 5,389,113 | A | 2/1995 | Demmering et al. | 44/388 |
| 5,391,632 | A | 2/1995 | Krull et al. | 525/327.6 |
| 5,705,603 | A | 1/1998 | Krull et al. | 528/332 |
| 5,767,190 | A | 6/1998 | Krull et al. | 524/563 |
| 5,789,510 | A | 8/1998 | Krull et al. | 526/281 |
| 6,565,616 | B1 * | 5/2003 | Krull et al. | 44/329 |

FOREIGN PATENT DOCUMENTS

| | | |
|---|---|---|
| DE | 34 43 475 | 5/1986 |
| DE | 40 40 317 | 6/1992 |
| DE | 196 14 722 | 10/1997 |
| DE | 196 20 118 | 10/1997 |
| DE | 196 20 119 | 10/1997 |
| DE | 693 26 754 | 5/2000 |
| DE | 101 11 857 | 9/2002 |
| EP | 0 061894 | 10/1982 |
| EP | 0 153 176 | 8/1985 |
| EP | 0 153 177 | 8/1985 |
| EP | 0 154 177 | 9/1985 |
| EP | 0 203 554 | 12/1986 |
| EP | 0 214 786 | 3/1987 |
| EP | 214786 A1 * | 3/1987 |
| EP | 0 254 284 | 1/1988 |
| EP | 0 271 738 | 6/1988 |
| EP | 0 282 342 | 9/1988 |
| EP | 0 320 766 | 6/1989 |
| EP | 0 398 101 | 11/1990 |
| EP | 0 405 270 | 1/1991 |
| EP | 0 413 279 | 2/1991 |
| EP | 0 463 518 | 1/1992 |
| EP | 0 493 769 | 7/1992 |
| EP | 0 543 356 | 5/1993 |
| EP | 0 606 055 | 7/1994 |
| EP | 0 629 231 | 12/1994 |
| EP | 0 635 558 | 1/1995 |
| EP | 0 665 873 | 8/1995 |
| EP | 0 680 506 | 8/1995 |
| EP | 0 688 796 | 12/1995 |

(Continued)

OTHER PUBLICATIONS

English abstract for DE 34 43 475.

(Continued)

*Primary Examiner*—David W. Wu
*Assistant Examiner*—Satya Sastri
(74) *Attorney, Agent, or Firm*—Richard P. Silverman

(57) ABSTRACT

The present invention provides an additive for improving the cold flow properties of vegetable or animal fuel oil. The additive comprises A) a copolymer of ethylene and 8–21 mol % of at least one acrylic or vinyl ester having a $C_1$–$C_{18}$-alkyl radical and B) a comb polymer of at least one $C_8$–$C_{16}$-alkyl ester of an ethylenically unsaturated dicarboxylic acid and at least one $C_{10}$–$C_{20}$-olefin, wherein the sum Q $$Q = \sum_i w_{1i} \cdot n_{1i} + \sum_j w_{2j} \cdot n_{2j}$$

of the molar averages of the carbon chain distributions in the alkyl side chains of the olefins (monomer 1) and the fatty alcohols (monomer 2) is from 23 to 27. In Q, $w_1$ and $w_2$ are the molar proportions of the individual chain lengths in the comb polymer from the different monomers 1 and 2, and $n_1$ and $n_2$ are the side chain carbon atom lengths, excluding comb polymer bonded carbon atoms of monomer 1, and the running variables i and j are the individual side chain lengths in the particular monomer groups.

15 Claims, No Drawings

FOREIGN PATENT DOCUMENTS

| | | | |
|---|---|---|---|
| EP | 0 739 970 | | 10/1996 |
| EP | 0 778 879 | | 6/1997 |
| EP | 0 839 174 | | 5/1998 |
| EP | 0 935 645 | | 8/1999 |
| EP | 1 146 108 | | 10/2001 |
| EP | 1146108 | A2 * | 10/2001 |
| GB | 907177 | | 11/1962 |
| WO | WO 93/18115 | | 9/1993 |
| WO | WO 94/10267 | | 5/1994 |
| WO | 96/18706 | | 6/1996 |
| WO | WO 9846701 | A1 * | 10/1998 |
| WO | 99/61562 | | 12/1999 |
| WO | 01/19941 | | 3/2001 |

OTHER PUBLICATIONS

English abstract for EP 0 203 554.
English abstract for EP 0 254 284.
English abstract for EP 0 271 738.
English abstract for EP 0 405 270.
English abstract for EP 0 543 356.
English Abstract for EP 0 398 101.
English Abstract for DE 101 11 857.
English Abstract for DE 196 14 722.
Roemp Chemi Lexicon, 9th Edition, Thieme Verlag, 1988-1992, vol. 4 p. 3351ff.
N.A.Plate and V.P. Shibaev, "Comb-like Polymers-Structure and Properties", J. Polymer Science Macromolecular Review, 1974, vol. 8, p. 117fff.
D. Wei, H. Spikes, The Lubricity of Diesel Fuels, Wear, vol. 111 No. 2, p217-235 (1986).

* cited by examiner

COLD FLOW IMPROVERS FOR FUEL OILS OF VEGETABLE OR ANIMAL ORIGIN

The present invention relates to an additive, to its use as a cold flow improver for vegetable or animal fuel oils and to correspondingly additized fuel oils.

In view of decreasing world crude oil reserves and the discussion about the environmentally damaging consequences of the use of fossil and mineral fuels, there is increasing interest in alternative energy sources based on renewable raw materials. These include in particular natural oils and fats of vegetable or animal origin. These are generally triglycerides of fatty acids having from 10 to 24 carbon atoms and a calorific value comparable to conventional fuels, but are at the same time classified as biodegradable and environmentally compatible.

Oils obtained from animal or vegetable material are mainly metabolism products which include triglycerides of monocarboxylic acids, for example acids having from 10 to 25 carbon atoms, and corresponding to the formula

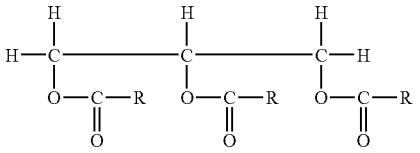

where R is an aliphatic radical which has from 10 to 25 carbon atoms and may be saturated or unsaturated.

In general, such oils contain glycerides from a series of acids whose number and type vary with the source of the oil, and they may additionally contain phosphoglycerides. Such oils can be obtained by processes known from the prior art.

As a consequence of the sometimes unsatisfactory physical properties of the triglycerides, the industry has applied itself to converting the naturally occurring triglycerides to fatty acid esters of low alcohols such as methanol or ethanol.

A hindrance to the use of fatty acid esters of lower monohydric alcohols as a replacement for diesel fuel alone or in a mixture with diesel fuel has proven to be the flow behavior at low temperatures. The cause of this is the high uniformity of these oils in comparison to mineral oil middle distillates. For example, the rapeseed oil methyl ester (RME) has a CFPP of −14° C. It has hitherto been impossible using the prior art additives to reliably obtain a CFPP value of −20° C. required for use as a winter diesel in Central Europe, or of −22° C. or lower for special applications. This problem is increased when oils are used which comprise relatively large amounts of the likewise readily available oils of sunflowers and soya.

EP-B-0 665 873 discloses a fuel oil composition which comprises a biofuel, a fuel oil based on crude oil and an additive which comprises (a) an oil-soluble ethylene copolymer or (b) a comb polymer or (c) a polar nitrogen compound or (d) a compound in which at least one substantially linear alkyl group having from 10 to 30 carbon atoms is bonded to a nonpolymeric organic radical, in order to provide at least one linear chain of atoms which includes the carbon atoms of the alkyl groups and one or more nonterminal oxygen atoms, or (e) one or more of the components (a), (b), (c) and (d).

EP-B-0 629 231 discloses a composition which comprises a relatively large proportion of oil which consists substantially of alkyl esters of fatty acids which are derived from vegetable or animal oils or both, mixed with a small proportion of mineral oil cold flow improvers which comprises one or more of the following:

(I) comb polymer, the copolymer (which may be esterified) of maleic anhydride or fumaric acid and another ethylenically unsaturated monomer, or polymer or copolymer of α-olefin, or fumarate or itaconate polymer or copolymer, (II) polyoxyalkylene ester, ester/ether or a mixture thereof, (III) ethylene/unsaturated ester copolymer, (IV) polar, organic, nitrogen-containing paraffin crystal growth inhibitor, (V) hydrocarbon polymer, (VI) sulfur-carboxyl compounds and (VII) aromatic pour point depressant modified with hydrocarbon radicals, with the proviso that the composition comprises no mixtures of polymeric esters or copolymers of esters of acrylic and/or methacrylic acid which are derived from alcohols having from 1 to 22 carbon atoms.

EP-B-0 543 356 discloses a process for preparing compositions having improved low temperature behavior for use as fuels or lubricants, starting from the esters of naturally occurring long-chain fatty acids with monohydric $C_1$–$C_6$-alcohols (FAE), which comprises a) adding PPD additives (pour point depressants) known per se and used for improving the low temperature behavior of mineral oils in amounts of from 0.0001 to 10% by weight, based on the long-chain fatty acid esters FAE and b) cooling the nonadditized long-chain fatty acid esters FAE to a temperature below the Cold Filter Plugging Point and c) removing the resulting precipitates (FAN).

DE-A-40 40 317 discloses mixtures of fatty acid lower alkyl esters having improved cold stability comprising a) from 58 to 95% by weight of at least one ester within the iodine number range from 50 to 150 and being derived from fatty acids having from 12 to 22 carbon atoms and lower aliphatic alcohols having from 1 to 4 carbon atoms, b) from 4 to 40% by weight of at least one ester of fatty acids having from 6 to 14 carbon atoms and lower aliphatic alcohols having from 1 to 4 carbon atoms and c) from 0.1 to 2% by weight of at least one polymeric ester.

EP-B-0 153 176 discloses the use of polymers based on unsaturated dialkyl $C_4$–$C_8$-dicarboxylates having an average alkyl chain length of from 12 to 14 as cold flow improvers for certain crude oil distillate fuel oils. Mentioned as suitable comonomers are in particular vinyl esters, but also α-olefins.

EP-B-0 153 177 discloses an additive concentrate which comprises a combination of I) a copolymer having at least 25% by weight of an n-alkyl ester of a monoethylenically unsaturated $C_4$–$C_8$-mono- or -dicarboxylic acid, the average number of carbon atoms in the n-alkyl radicals being 12–14, and another unsaturated ester or an olefin, with II) another low temperature flow improver for distillate fuel oils.

It has hitherto often been impossible using the existing additives to reliably attain a CFPP value of −20° C. required for use as a winter diesel in Central Europe or of −22° C. and lower for special applications. An additional problem with the existing additives is the lacking cold temperature change stability of the additized oils, i.e. the CFPP value of the oils attained rises gradually when the oil is stored for a prolonged period at changing temperatures in the region of the cloud point or below.

It is therefore an object of the invention to provide additives for improving the cold flow behavior of fatty acid esters of monohydric alcohols which are derived, for example, from rapeseed oil, sunflower oil and/or soya oil and attain CFPP values of −20° C. and below which remain constant even when the oil is stored for a prolonged period in the region of its cloud point or below.

It has now been found that, surprisingly, an additive comprising ethylene copolymers, comb polymers and optionally polyalkyl (meth)acrylates is an excellent flow improver for such fatty acid esters.

The invention therefore provides an additive comprising

A) a copolymer of ethylene and 8–21 mol % of at least one acrylic or vinyl ester having a $C_1$–$C_{18}$-alkyl radical and B) a comb polymer of at least one $C_8$–$C_{16}$-alkyl ester of an ethylenically unsaturated dicarboxylic acid and at least one $C_{10}$–$C_{20}$-olefin, wherein the sum Q $$Q = \sum_i w_{1i} \cdot n_{1i} + \sum_j w_{2j} \cdot n_{2j}$$

of the molar-averages of the carbon chain distributions in the alkyl side chains of the olefins on the one hand and the fatty alcohols in the ester groups on the other hand is from 23 to 27, where $w_1$ and $w_2$ are the molar proportions of the individual chain lengths in the different monomers 1 (olefin) and 2 (ester), and $n_1$ and $n_2$ are the side chain lengths, in the case of olefins without the originally olefinically bonded carbon atoms, of the individual species, and the running variables i and j are the individual side chains in the particular monomer groups.

The invention further provides a fuel oil composition comprising a fuel oil of animal or vegetable origin and the above-defined additive.

The invention further provides the use of the above-defined additive for improving the cold flow properties or fuel oils of animal or vegetable origin.

The invention further provides a process for improving the cold flow properties of fuel oils of animal or vegetable origin by adding the above-defined additive to fuel oils of animal or vegetable origin.

In a preferred embodiment of the invention, Q has values of from 24 to 26.

Useful ethylene copolymers A) are those which contain from 8 to 21 mol % of vinyl and/or (meth)acrylic ester and from 79 to 92 mol % of ethylene. Particular preference is given to ethylene copolymers having from 10 to 18 mol % and especially from 12 to 16 mol %, of at least one vinyl ester. Suitable vinyl esters are derived from fatty acids having linear or branched alkyl groups having from 1 to 30 carbon atoms. Examples include vinyl acetate, vinyl propionate, vinyl butyrate, vinyl hexanoate, vinyl heptanoate and vinyl octanoate, and also esters of vinyl alcohol based on branched fatty acids, such as vinyl isobutyrate, vinyl pivalate, vinyl 2-ethylhexanoate, vinyl neononanoate, vinyl neodecanoate and vinyl neoundecanoate. Likewise suitable as comonomers are esters of acrylic and methacrylic acids having from 1 to 20 carbon atoms in the alkyl radical, such as methyl (meth)acrylate, ethyl (meth)acrylate, propyl (meth)acrylate, n- and isobutyl (meth)acrylate, and hexyl, octyl, 2-ethylhexyl, decyl, dodecyl, tetradecyl, hexadecyl and octadecyl (meth)acrylate, and also mixtures of two, three, four or else more of these comonomers.

Apart from ethylene, particularly preferred terpolymers of vinyl 2-ethylhexanoate, of vinyl neononanoate or of vinyl neodecanoate contain preferably from 3.5 to 20 mol %, in particular from 8 to 15 mol %, of vinyl acetate, and from 0.1 to 12 mol %, in particular from 0.2 to 5 mol %, of the particular long-chain vinyl ester, the total comonomer content being between 8 and 21 mol %, preferably between 12 and 18 mol %. In addition to ethylene and from 8 to 18 mol % of vinyl esters, further preferred copolymers additionally contain from 0.5 to 10 mol % of olefins such as propene, butene, isobutylene, hexene, 4-methylpentene, octene, diisobutylene and/or norbornene.

The copolymers A preferably have molecular weights which correspond to melt viscosities at 140° C. of from 20 to 10 000 mPas, in particular from 30 to 5000 mPas, and especially from 50 to 1000 mPas. The degrees of branching determined by means of $^1H$ NMR spectroscopy are preferably between 2 and 9 $CH_3$/100 $CH_2$ groups, in particular between 2.5 and 6 $CH_3$/100 $CH_2$ groups, which do not stem from the comonomers. Preferably, the copolymers which make up copolymer A have molecular weights of between 3000 and 15 000 g/mol (by gel permeation chromatography (GPC) against poly(styrene)).

The copolymers (A) can be prepared by the customary copolymerization processes, for example suspension polymerization, solution polymerization, gas phase polymerization or high pressure bulk polymerization. Preference is given to carrying out the high pressure bulk polymerization at pressures of from 50 to 400 MPa, preferably from 100 to 300 MPa, and temperatures from 100 to 300° C., preferably from 150 to 220° C. In a particularly preferred preparation variant, the polymerization is effected in a multizone reactor in which the temperature difference between the peroxide feeds along the tubular reactor is kept very low, i.e. <50° C., preferably <30° C., in particular <15° C. The temperature maxima in the individual reaction zones preferably differ by less than 30° C., more preferably by less than 20° C. and especially by less than 10° C.

The reaction of the monomers is initiated by radical-forming initiators (radical chain initiators). This substance class includes, for example, oxygen, hydroperoxides, peroxides and azo compounds, such as cumene hydroperoxide, t-butyl hydroperoxide, dilauroyl peroxide, dibenzoyl peroxide, bis(2-ethylhexyl) peroxydicarbonate, t-butyl perpivalate, t-butyl permaleate, t-butyl perbenzoate, dicumyl peroxide, t-butyl cumyl peroxide, di(t-butyl) peroxide, 2,2'-azobis(2-methylpropanonitrile), 2,2'-azobis(2-methylbutyronitrile). The initiators are used individually or as a mixture of two or more substances in amounts of from 0.01 to 20% by weight, preferably from 0.05 to 10% by weight, based on the monomer mixture.

The high pressure bulk polymerization is carried out in known high pressure reactors, for example autoclaves or tubular reactors, batchwise or continuously, and tubular reactors have proven particularly useful. Solvents such as aliphatic and/or aromatic hydrocarbons or hydrocarbon mixtures, benzene or toluene may be present in the reaction mixture. Preference is given to the substantially solvent-free procedure. In a preferred embodiment of the polymerization, the mixture of the monomers, the initiator and, if used, the moderator, are fed to a tubular reactor via the reactor entrance and also via one or more side branches. The comonomers may be metered into the reactor either together with ethylene or else separately via sidestreams. The monomer streams may have different compositions (EP-A-0 271 738 and EP-A-0 922 716).

Examples of suitable co- or terpolymers include:

ethylene-vinyl acetate copolymers having 10–40% by weight of vinyl acetate and 60–90% by weight of ethylene;

the ethylene-vinyl acetate-hexene terpolymers known from DE-A-34 43 475;

the ethylene-vinyl acetate-diisobutylene terpolymers described in EP-B-0 203 554;

the mixture of an ethylene-vinyl acetate-diisobutylene terpolymer and an ethylene/vinyl acetate copolymer known from EP-B-0 254 284;

the mixtures of an ethylene-vinyl acetate copolymer and an ethylene-vinyl acetate-N-vinylpyrrolidone terpolymer disclosed in EP-B-0 405 270;

the ethylene/vinyl acetate/isobutyl vinyl ether terpolymers described in EP-B-0 463 518;

the ethylene/vinyl acetate/neononanoate or -vinyl neodecanoate terpolymers which, apart from ethylene, contain 10–35% by weight of vinyl acetate and 1–25% by weight of the particular neo compound, known from EP-B-0 493 769;

the terpolymers of ethylene, a first vinyl ester having up to 4 carbon atoms and a second vinyl ester which is derived from a branched carboxylic acid having up to 7 carbon atoms or a branched but nontertiary carboxylic acid having from 8 to 15 carbon atoms, described in EP 0778875;

the terpolymers of ethylene, the vinyl ester of one or more aliphatic $C_2$- to $C_{20}$-monocarboxylic acids and 4-methylpentene-1, described in DE-A-196 20 118;

the terpolymers of ethylene, the vinyl ester of one or more aliphatic $C_2$- to $C_{20}$-monocarboxylic acids and bicyclo [2.2.1]hept-2-ene, disclosed in DE-A-196 20 119.

The mixing ratio (in parts by weight) of the additives according to the invention with paraffin dispersants is from 1:10 to 20:1, preferably from 1:1 to 10:1.

The copolymers B are preferably derived from dicarboxylic acids and their derivatives such as esters and anhydrides. Preference is given to maleic acid, fumaric acid, itaconic acid and especially maleic anhydride. Particularly suitable comonomers are olefins having from 10 to 20, in particular having 12–18, carbon atoms. These are preferably linear and the double bond is terminal as, for example, in dodecene, tridecene, tetradecene, pentadecene, hexadecene, heptadecene and octadecene. The ratio of maleic anhydride to olefin or olefins in the polymer is preferably in the range from 1:1.5 to 1.5:1, and it is especially equimolar. Also present may be minor amounts of up to 20 mol %, preferably <10 mol %, especially <5 mol %, of further comonomers which are copolymerizable with maleic anhydride and the olefins specified, for example relatively short- and relatively long-chain olefins, allyl polyglycol ethers, $C_1$–$C_{30}$-alkyl (meth)acrylates, vinylaromatics or $C_1$–$C_{20}$-alkyl vinyl ethers. Poly(isobutylene) having a molecular weight up to 5000 g/mol are likewise used in minor amounts, and preference is given to highly reactive variants having a high proportion of terminal vinylidene groups. These further comonomers are not taken into account in the calculation of the factor Q determining the effectiveness.

Alkyl polyglycol ethers correspond to the general formula

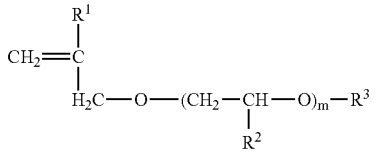

where $R^1$ is hydrogen or methyl, $R^2$ is hydrogen or $C_1$–$C_4$-alkyl, m is a number from 1 to 100, $R^3$ is $C_1$–$C_{24}$-alkyl, $C_5$–$C_{20}$-cycloalkyl, $C_6$–$C_{18}$-aryl or —C(O)—$R^4$, $R^4$ is $C_1$–$C_{40}$-alkyl, $C_5$–$C^{10}$-cycloalkyl or $C_6$–$C_{18}$-aryl.

The copolymers B) according to the invention are preferably prepared at temperatures between 50 and 220° C., in particular from 100 to 190° C., especially from 130 to 170° C. The preferred preparative process is the solvent-free bulk polymerization, although it is also possible to carry out the polymerization in the presence of aprotic solvents such as benzene, toluene, xylene or of relatively high-boiling aromatic, aliphatic or isoaliphatic solvents or solvent mixtures, such as kerosene or Solvent Naphtha. Particular preference is given to the polymerization in aliphatic or isoaliphatic solvents having little moderating influence. The proportion of solvent in the polymerization mixture is generally between 10 and 90% by weight, preferably between 35 and 60% by weight. In the case of the solution polymerization, the reaction temperature can be set in a particularly simple manner via the boiling point of the solvent or by working under reduced or elevated pressure.

The reaction of the monomers is initiated by radical-forming initiators (radical chain initiators). This substance class includes, for example, oxygen, hydroperoxides and peroxides such as cumene hydroperoxide, t-butyl hydroperoxide, dilauroyl peroxide, dibenzoyl peroxide, bis(2-ethylhexyl) peroxydicarbonate, t-butyl perpivalate, t-butyl permaleate, t-butyl perbenzoate, dicumyl peroxide, t-butyl cumyl peroxide, di(t-butyl) peroxide, and azo compounds such as 2,2'-azobis(2-methylpropanonitrile) or 2,2'-azobis (2-methylbutyronitrile). The initiators are used individually or as a mixture of two or more substances in amounts of from 0.01 to 20% by weight, preferably from 0.05 to 10% by weight, based on the monomer mixture.

The copolymers can be prepared either by esterification of maleic acid, fumaric acid and/or itaconic acid with the appropriate alcohols and subsequent copolymerization or by copolymerization of olefin or olefins with itaconic anhydride and/or maleic anhydride and subsequent esterification. Preference is given to carrying out a copolymerization with anhydrides and esterifying the resultant copolymer after the preparation.

In both cases, this esterification is effected, for example, by reacting with from 0.8 to 2.5 mol of alcohol per mole of anhydride, preferably with from 1.0 to 2.0 mol of alcohol per mole of anhydride, at from 50 to 300° C. When approx. 1 mol of alcohol is used per mole of anhydride, monoesters are formed. Preference is given to esterification temperatures of from approx. 70 to 120° C. When relatively large amounts of alcohol are used, preferably 2 mol of alcohol per mole of anhydride, diesters are formed at 100–300° C., preferably 120–250° C. The water of reaction can be distilled off by means of an inert gas stream or removed by means of azeotropic distillation in the presence of an organic solvent. For this purpose, preference is given to using 20–80% by weight, in particular 30–70% by weight, especially 35–55% by weight, of at least one organic solvent. Useful monoesters are copolymers having acid numbers of 30–70 mg of KOH/g, preferably 40–60 mg of KOH/g. Copolymers having acid numbers of less than 40 mg of KOH/g, especially less than 30 mg of KOH/g, are considered diesters. Particular preference is given to monoesters.

Suitable alcohols are, in particular, linear, although they may also contain minor amounts, for example up to 30% by weight, preferably up to 20% by weight and especially up to 10% by weight, of branched (in the 1- or 2-position) alcohols. Particular preference is given to octanol, decanol, undecanol, dodecanol, tridecanol, tetradecanol, pentadecanol and hexadecanol. The use of mixtures of different olefins in the polymerization and mixtures of different alcohols in the esterification allows the effectiveness to be adapted further to specific fatty acid ester compositions.

In a preferred embodiment, the additives, in addition to constituents A and B, may also comprise polymers and copolymers based on $C_{10}$–$C_{24}$-alkyl acrylates or methacrylates (constituent C). These poly(alkyl acrylates) and methacrylates have molecular weights of from 800 to 1 000 000 g/mol and are preferably derived from caprylic alcohol, caproic alcohol, undecyl alcohol, lauryl alcohol, myristyl alcohol, cetyl alcohol, palmitoleyl alcohol, stearyl alcohol or mixtures thereof, for example coconut alcohol, palm alcohol, tallow fatty alcohol or behenyl alcohol.

In a preferred embodiment, mixtures of the copolymers B according to the invention are used, with the proviso that the mean of the Q values of the mixing components in turn assumes values of from 23 to 27 and preferably values from 24 to 26.

The mixing ratio of the additives A and B according to the invention is (in parts by weight) from 20:1 to 1:20, preferably from 10:1 to 1:10, in particular from 5:1 to 1:2. The proportion of component C in the formulations of A, B and C may be up to 40% by weight; it is preferably less than 20% by weight, in particular between 1 and 10% by weight.

The additives according to the invention are added to oils in amounts of from 0.001 to 5% by weight, preferably from 0.005 to 1% by weight and especially from 0.01 to 0.5% by weight. They may be used as such or else dissolved or dispersed in solvents, for example aliphatic and/or aromatic hydrocarbons or hydrocarbon mixtures, for example toluene, xylene, ethylbenzene, decane, pentadecane, petroleum fractions, kerosene, naphtha, diesel, heating oil, isoparaffins or commercial solvent mixtures such as Solvent Naphtha, ®Shellsol AB, ®Solvesso 150, ®Solvesso 200, ®Exxsol, ®Isopar and ®Shellsol D types. They are preferably dissolved in fuel oil of animal or vegetable origin based on fatty acid alkyl esters. The additives according to the invention preferably comprise 1–80%, especially 10–70%, in particular 25–60%, of solvent.

In a preferred embodiment, the fuel oil, which is frequently also referred to as biodiesel or biofuel, is a fatty acid alkyl ester made from fatty acids having from 14 to 24 carbon atoms and alcohols having from 1 to 4 carbon atoms. Typically, a relatively large portion of the fatty acids contains one, two or three double bonds. These are more preferably, for example, rapeseed oil acid methyl ester and especially mixtures which comprise rapeseed oil fatty acid methyl ester, sunflower oil fatty acid methyl ester and/or soya oil fatty acid methyl ester. The additives according to the invention can be used equally successfully in mixtures of fatty acid methyl esters and mineral oil diesel. Such mixtures preferably contain up to 25% by weight, in particular up to 10% by weight, especially up to 5% by weight, of fuel oil of animal or vegetable origin.

Examples of oils which are derived from animal or vegetable material and in which the additive according to the invention can be used are rapeseed oil, coriander oil, soya oil, cottonseed oil, sunflower oil, castor oil, olive oil, peanut oil, maize oil, almond oil, palmseed oil, coconut oil, mustardseed oil, bovine tallow, bone oil and fish oils. Further examples include oils which are derived from wheat, jute, sesame, shea tree nut, arachis oil and linseed oil. The fatty acid alkyl esters also referred to as biodiesel can be derived from these oils by processes known from the prior art. Rapeseed oil, which is a mixture of fatty acids partially esterified with glycerol, is preferred, since it is obtainable in large amounts and is obtainable in a simple manner by extractive pressing of rapeseeds. In addition, preference is given to the likewise widely available oils of sunflowers and soya, and also to their mixtures with rapeseed oil.

Useful low alkyl esters of fatty acids include the following, for example as commercially available mixtures: the ethyl, propyl, butyl and in particular methyl esters of fatty acids having from 12 to 22 carbon atoms, for example of lauric acid, myristic acid, palmitic acid, palmitolic acid, stearic acid, oleic acid, elaidic acid, petroselic acid, ricinolic acid, elaeostearic acid, linolic acid, linolenic acid, eicosanoic acid, gadoleinic acid, docosanoic acid or erucic acid, each of which preferably has an iodine number of from 50 to 150, in particular from 90 to 125. Mixtures having particularly advantageous properties are those which comprise mainly, i.e. comprise at least 50% by weight, methyl esters of fatty acids having from 16 to 22 carbon atoms, and 1, 2 or 3 double bonds. The preferred relatively low alkyl esters of fatty acids are the methyl esters of oleic acid, linoleic acid, linolenic acid and erucic acid.

Commercial mixtures of the type mentioned are obtained, for example, by hydrolyzing and esterifying animal and vegetable fats and oils by transesterifying them with relatively low aliphatic alcohols. To prepare relatively low alkyl esters of fatty acids, it is advantageous to start from fats and oils having a high iodine number, for example sunflower oil, rapeseed oil, coriander oil, castor oil, soya oil, cottonseed oil, peanut oil or bovine tallow. Preference is given to relatively low alkyl esters of fatty acids based on a novel type of rapeseed oil, more than 80% by weight of whose fatty acid component is derived from unsaturated fatty acids having 18 carbon atoms.

Particular preference is given to oils according to the invention which can be used as biofuels. Biofuels, i.e. fuels derived from animal or vegetable material, are regarded as being less damaging to the environment on combustion and are obtained from a renewable source. It has been reported that less carbon dioxide is formed on combustion than by an equivalent amount of crude oil distillate fuel, for example diesel fuel, and very little sulfur dioxide is formed. Certain derivatives of vegetable oil, for example those which are obtained by hydrolyzing and reesterifying with a monovalent alkyl alcohol, can be used as a replacement for diesel oil. Equally suitable as fuels are also used cooking oils. It has been reported recently that mixtures of rapeseed oil esters, for example rapeseed oil methyl ester (RME), with crude oil distillate fuels in ratios of, for example, 10:90 (based on the volume) will be commercially obtainable in the near future. The additives according to the invention are also suitable for such mixtures.

A biofuel is therefore an oil which is obtained from vegetable or animal material or both or a derivative thereof which can be used as a fuel.

Although many of the above oils can be used as biofuels, preference is given to vegetable oil derivatives, and particularly preferred biofuels are alkyl ester derivatives of rapeseed oil, cottonseed oil, soya oil, sunflower oil, olive oil or palm oil, and very particular preference is given to rapeseed oil methyl ester.

The additive can be introduced into the oil to be additized in accordance with prior art processes. When more than one additive component or coadditive component is to be used, such components can be introduced into the oil together or separately in any desired combination.

The additives according to the invention allow the CFPP value of biodiesel to be adjusted to values of below −20° C. and sometimes to values of below −25° C., as required for provision on the market for use in winter in particular. This also applies to problematic oils which comprise a high content of oils from sunflowers and soya. In addition, the oils additized in this way have a good cold temperature change stability, i.e. the CFPP value remains constant even on storage under winter conditions.

To prepare additive packages for specific solutions to problems, the additives according to the invention can also be used together with one or more oil-soluble coadditives which alone improve the cold flow properties of crude oils, lubricant oils or fuel oils. Examples of such coadditives are polar compounds which effect paraffin dispersion (paraffin dispersants) and also oil-soluble amphiphils.

The additives according to the invention can be used in a mixture with paraffin dispersants. Paraffin dispersants reduce the size of the paraffin crystals and have the effect that the paraffin particles do not separate but remain dispersed colloidally with a distinctly reduced tendency to sedimentation. Useful paraffin dispersants have proven to be oil-soluble polar compounds having ionic or polar groups, for example amine salts and/or amides, which are obtained by reacting aliphatic or aromatic amines, preferably long-chain aliphatic amines, with aliphatic or aromatic mono-, di-, tri- or tetracarboxylic acids or their anhydrides (cf. U.S. Pat. No. 4,211,534). Other paraffin dispersants are copolymers of maleic anhydride and α,β-unsaturated compounds which may optionally be reacted with primary monoalkylamines and/or aliphatic alcohols (cf. EP 0 154 177), the reaction products of alkenyl-spiro-bislactones with amines (cf. EP 0 413 279 B1) and, according to EP 0 606 055 A2, reaction products of terpolymers based on α,β-unsaturated dicarboxylic anhydrides, α,β-unsaturated compounds and polyoxyalkylene ethers of lower unsaturated alcohols.

The mixing ratio (in parts by weight) of the additives according to the invention with paraffin dispersants is from 1:10 to 20:1, preferably from 1:1 bis 10:1.

Apart from in the fuel oils of animal or vegetable origin described, the additives according to the invention can also be used in mixtures of such oils with middle distillates. The mixing ratio between the biofuel oils and middle distillates may be between 1:99 and 99:1. Particular preference is given to biofuel:middle distillate mixing ratios of from 1:99 to 10:90.

Middle distillates are in particular mineral oils which are obtained by distilling crude oil and boil in the range from 120 to 450° C., for example kerosene, jet fuel, diesel and heating oil. Preference is given to using those middle distillates which comprise 0.05% by weight of sulfur and less, more preferably less than 350 ppm of sulfur, in particular less than 200 ppm of sulfur and in special cases less than 50 ppm of sulfur. These are generally those middle distillates which have been subjected to refining under hydrogenating conditions and therefore contain only small fractions of polyaromatic and polar compounds. They are preferably middle distillates which have 95% distillation points below 370° C., in particular 350° C. and in special cases below 330° C. Synthetic fuels, as obtainable, for example, by the Fischer-Tropsch process, are also suitable as middle distillates.

The additives can be used alone or else together with other additives, for example with other pour point depressants or dewaxing assistants, with corrosion inhibitors, antioxidants, sludge inhibitors, dehazers and additives for reducing the cloud point.

EXAMPLES

Characterization of the Test Oils:

The CFPP value is determined to EN 116 and the cloud point is determined to ISO 3015.

TABLE 1

Characterization of the test oils used

| Oil No. | | CP | CFPP |
|---|---|---|---|
| E 1 | Rapeseed oil acid methyl ester | −2.3 | −14° C. |
| E 2 | 80% of rapeseed oil acid methyl ester + 20% of sunflower oil acid methyl ester | −1.6 | −10° C. |
| E 3 | 90% of rapeseed oil acid methyl ester + 10% of soya oil acid methyl ester | −2.0 | −8° C. |

The following additives were used:

Ethylene copolymers A

The ethylene copolymers used are commercial products having the characteristics specified in Table 2. The products were used as 65% or 50% (A3) dilutions in kerosene.

TABLE 2

Characterization of the ethylene copolymers used

| Example | Comonomer(s) | V140 | $CH_3$/100 $CH_2$ |
|---|---|---|---|
| A1 | 13.6 mol % of vinyl acetate | 130 mPas | 3.7 |
| A2 | 13.7 mol % of vinyl acetate and 1.4 mol % of vinyl neodecanoate | 105 mPas | 5.3 |
| A3 (C) | 11.2 mol % of vinyl acetate | 220 mPas | 6.2 |
| A4 (C) | Mixture of EVA copolymer having 16 mol % of vinyl acetate with EVA having 5 mol % of vinyl acetate in a 13:1 ratio | 95 mPas/350 mPas | 3.2/5.7 |

Comb Polymers B

Maleic anhydride was polymerized with a-olefins (similarly to EP 0606055) in a relatively high-boiling aromatic hydrocarbon mixture at 160° C. in the presence of a mixture of equal parts of tert-butyl peroxybenzoate and tert-butyl peroxy-2-ethylhexanoate as a radical chain initiator. Table 3 lists the molar ratios of the monomers, the chain length of the fatty alcohol used for esterification and the factor Q calculated therefrom.

The esterifications are effected in the presence of Solvent Naphtha (40–50% by weight) at 90–100° C. to give the monoester and at 160–180° C. with azeotropic separation of water of reaction to give the diester. The degree of esterification is inversely proportional to the acid number.

TABLE 3

Characterization of the comb polymers used

| Example | Comonomers | Alcohol | Q | Acid number [mg KOH/g] |
|---|---|---|---|---|
| B1 | MA-co-C14/16-α-olefin (1:0.5:0.5) | C10 | 23.0 | 47.0 |
| B2 | MA-co-C14/16-α-olefin (1:0.5:0.5) | C10 | 23.0 | 8.5 |
| B3 | MA-co-C14/16-α-olefin (1:0.5:0.5) | C12 | 25.0 | 48.2 |
| B4 | MA-co-C14/16-α-olefin (1:0.5:0.5) | C12 | 25.0 | 28.8 |
| B5 | MA-co-C14/16-α-olefin (1:0.5:0.5) | C14 | 27.0 | 51.0 |
| B6 | MA-co-C12/14-α-olefin (1:0.5:0.5) | C14 | 25.0 | 44.8 |
| B7 | MA-co-C12/14-α-olefin (1:0.5:0.5) | C12 | 23.0 | 51.1 |
| B8 | MA-co-C14/16-α-olefin (1:0.5:0.5) | 85% C12<br>15% C16 | 25.6 | 49.9 |
| B9 | MA-co-C16-α-olefin (1:1) | C12 | 26.0 | 12.3 |
| B10 | MA-co-C14-α-olefin (1:0.5:0.5) | C14 | 26.0 | 46.3 |
| B11 | MA-co-C14-α-olefin (1:0.5:0.5) | C12 | 24.0 | 49.3 |
| B12 | MA-co-C16-α-olefin (1:0.5:0.5) | C10 | 24.0 | 47.9 |
| B13 | MA-co-C16/18-α-olefin (1:0.5:0.5) | C10 | 25.0 | 53.0 |
| B14 | MA-co-C10-α-olefin (1:0.5:0.5) | 50% $C_{16}$<br>50% $C_{18}$ | 25.0 | 48.0 |
| B15 | MA-co-C14/16-α-olefin-co-(allyl methyl polyglycol) (1:0.45:0.45:0.1) | C12 | 25.0 | 45.8 |
| B16 (C) | MA-co-C16-α-olefin (1:1) | C12 | 26.0 | 49.1 |
| B17 | MA-co-C10-α-olefin (1:1) | C12 | 20.0 | 48.8 |
| B18 (C) | MA-co-C14/16-α-olefin (1:0.5:0.5) | C16 | 29.0 | 16.5 |
| B19 (C) | Fumarate-vinyl acetate | C14 | n. a. | 0.4 |
| B20 (C) | Fumarate-vinyl acetate | 50% C14<br>50% C16 | n. a. | 0.7 |

n.a.=not applicable

Poly(Alkyl(Meth)Acrylates) C

The poly(alkyl(meth)acrylates) used were the compounds listed in the table as 50% dilutions in relatively high-boiling solvent. The K values were determined according to Ubbelohde at 25° C. in 5% toluenic solution.

TABLE 4

Characterization of the poly(acrylates) used

| | |
|---|---|
| C1 | Poly(octadecyl acrylate), K value 32 |
| C2 | Poly(dodecyl acrylate), K value 35.6 |
| C3 | Poly(behenyl acrylate), K value 22.4 |

Effectiveness of the Terpolymers

The CFPP value (to EN 116, in ° C.) of different biofuels according to the above table was determined after the addition of 1200 ppm, 1500 ppm and also 2000 ppm, of additive mixture. Percentages relate to parts by weight in the particular mixtures. The results reported in Tables 5 to 7 show that comb polymers having the factor Q according to the invention achieve excellent CFPP reductions even at low dosages and offer additional potential at higher dosages.

TABLE 5

CFPP testing in test oil E1

| Ex. | Comb polymer | Ethylene copolymer | Poly-acrylate | CFPP in test oil 1 | | |
|---|---|---|---|---|---|---|
| | | | | 1200 ppm | 1500 ppm | 2000 ppm |
| 1 | 20% B1 | 80% A2 | — | −18 | −19 | −20 |
| 2 | 20% B2 | 80% A2 | — | −20 | −21 | −21 |
| 3 | 20% B3 | 80% A2 | — | −20 | −23 | −24 |
| 4 | 20% B4 | 80% A2 | — | −21 | −23 | −21 |
| 5 | 20% B5 | 80% A2 | — | −19 | −21 | −25 |
| 8 | 20% B8 | 80% A2 | — | −20 | −22 | −24 |
| 9 | 20% B9 | 80% A2 | — | −20 | −22 | −22 |

TABLE 5-continued

CFPP testing in test oil E1

| Ex. | Comb polymer | Ethylene copolymer | Poly-acrylate | CFPP in test oil 1 | | |
|---|---|---|---|---|---|---|
| | | | | 1200 ppm | 1500 ppm | 2000 ppm |
| 10 | 20% B10 | 80% A2 | — | −21 | −23 | −24 |
| 11 | 20% B11 | 80% A2 | — | −21 | −23 | −23* |
| 12 | 20% B12 | 80% A2 | — | −20 | −22 | −29 |
| 13 | 20% B13 | 80% A2 | — | −20 | −23 | −26 |
| 14 | 20% B14 | 80% A2 | — | −21 | −22 | −25 |
| 15 | 19% B8 | 76% A2 | 5% C1 | −20 | −22 | −25 |
| 16 | 19% B8 | 76% A2 | 5% C2 | −21 | −23 | −21 |
| 17 | 19% B8 | 76% A2 | 5% C3 | −20 | −24 | −26 |
| 18 | 34% B8 | 66% A2 | — | −20 | −22 | −24 |
| 19 | 50% B8 | 50% A2 | — | −19 | −22 | −23 |
| 20 | 20% B8 | 80% A1 | — | −20 | −23 | −24 |
| 21 | 20% B8 | 80% A3 | — | −19 | −20 | −21 |
| 22 | B15 | 80% A2 | — | −20 | −22 | −24 |
| 23 | B16 | 80% A2 | — | −20 | −21 | −24 |
| 24 | 10% B11<br>10% B16 | 80% A2 | — | −21 | −24 | −25 |
| 25 | 20% B9 | 80% A4 | — | −20 | −23 | −25 |
| 26 | 20% B13 | 80% A4 | — | −20 | −22 | −24 |
| 27 (C) | — | A2 | — | −14 | −16 | −10 |
| 28 (C) | — | A4 | — | −13 | −15 | −18 |
| 29 (C) | B17 | 80% A2 | — | −18 | −18 | −19 |
| 30 (C) | 20% B18 | 80% A2 | — | −17 | −18 | −18 |
| 31 (C) | 20% B19 | 80% A2 | — | −18 | −17 | −17 |
| 32 (C) | 20% B20 | 80% A2 | — | −18 | −20 | −13 |
| 33 (C) | — | — | C1 | −9 | −11 | −12 |
| 34 (C) | — | — | C3 | −18 | | −17 |

TABLE 6

CFPP testing in test oil E2

| Ex. | Comb polymer | Ethylene copolymer | Poly-acrylate | CFPP in test oil 2 1200 ppm | 1500 ppm | 2000 ppm |
|---|---|---|---|---|---|---|
| 35 | 20% B3 | 80% A2 | — | −20 | −21 | −24 |
| 36 | 20% B4 | 80% A2 | — | −19 | −21 | −23 |
| 37 | 20% B6 | 80% A2 | — | −20 | −22 | −23 |
| 38 | 20% B7 | 80% A2 | — | −19 | −22 | −21 |
| 39 | 20% B8 | 80% A2 | — | −19 | −21 | −23 |
| 40 | 20% B9 | 80% A2 | — | −18 | −19 | −20 |
| 41 | 20% B12 | 80% A2 | — | −19 | −22 | −24 |
| 42 | 20% B13 | 80% A2 | — | −18 | −22 | −28 |
| 43 | 20% B14 | 80% A2 | — | −19 | −23 | −26 |
| 44 | 20% B15 | 80% A2 | — | −19 | −22 | −25 |
| 45 | 20% B16 | 80% A2 | — | −18 | −23 | −26 |
| 46 | 10% B11 10% B16 | 80% A2 | — | −20 | −22 | −25 |
| 47 | 19% B8 | 76% A2 | 5% C1 | −19 | −23 | −25 |
| 48 | 19% B8 | 76% A2 | 5% C3 | −20 | −22 | −24 |
| 49 (C) | 20% B17 | 80% A2 | — | −15 | −17 | −18 |
| 50 (C) | 20% B18 | 80% A2 | — | −11 | −13 | −14 |
| 51 (C) | 20% B19 | 80% A2 | — | −16 | −17 | −19 |
| 52 (C) | 20% B20 | 80% A2 | — | −15 | −15 | −16 |

TABLE 7

CFPP testing in test oil E3

| Ex. | Comb polymer | Ethylene copolymer | Poly-acrylate | CFPP in test oil E3 1200 ppm | 2000 ppm |
|---|---|---|---|---|---|
| 53 | 20% B3 | 80% A2 | — | −19 | −24 |
| 54 | 20% B5 | 80% A2 | — | −15 | −14 |
| 55 | 20% B8 | 80% A2 | — | −19 | −24 |
| 56 | 20% B10 | 80% A2 | — | −21 | −24 |
| 57 | 20% B11 | 80% A2 | — | −18 | −24 |
| 58 | 20% B14 | 80% A2 | — | −18 | −24 |
| 59 | 10% B11 10% B16 | 80% A2 | — | −19 | −24 |
| 60 | 19% B8 | 76% A2 | 5% C1 | −20 | −23 |
| 61 | 19% B8 | 76% A2 | 5% C3 | −18 | −26 |
| 62 (C) | 20% B17 | 80% A2 | — | −15 | −17 |
| 63 (C) | 20% B18 | 80% A2 | — | −15 | −14 |
| 64 (C) | 20% B19 | 80% A2 | — | −14 | −17 |
| 65 (C) | 20% B20 | 80% A2 | — | −14 | −17 |

TABLE 7-continued

CFPP testing in test oil E3

| Ex. | Comb polymer | Ethylene copolymer | Poly-acrylate | CFPP in test oil E3 1200 ppm | 2000 ppm |
|---|---|---|---|---|---|
| 66 (C) | — | — | C1 | −14 | −14 |

Cold temperature change stability of fatty acid methyl esters

To determine the cold temperature change stability of an oil, the CFPP value to DIN EN 116 before and after a standardized cold temperature change treatment are compared.

500 ml of biodiesel (test oil E1) are treated with the appropriate cold temperature additive, introduced into a measuring cylinder and stored in a programmable cold chamber for a week. Within this time, a program is run through which repeatedly cools to −13° C. and then heats back to −3° C. 6 of these cycles are run through in succession (Table 8).

TABLE 8

Cooling program for determining the cold temperature change stability:

| Section | Time | End | Duration | Description |
|---|---|---|---|---|
| A→B | +5° C. | −3° C. | 8 h | Precooling to cycle start temperature |
| B→C | −3° C. | −3° C. | 2 h | Constant temperature, beginning of cycle |
| C→D | −3° C. | −13° C. | 14 h | Temperature reduction, commencement of crystal formation |
| D→E | −13° C. | −13° C. | 2 h | Constant temperature, crystal growth |
| E→F | −13° C. | −3° C. | 6 h | Temperature increase, melting of the crystals |
| F→B | | | | 6 further B→F cycles are carried out. |

Subsequently, the additized oil sample is heated to room temperature without agitation. A sample of 50 ml is taken for CFPP measurements from each of the upper, middle and lower sections of the measuring cylinder.

A deviation between the mean values of the CFPP values after storage and the CFPP value before storage and also between the individual phases of less than 3 K shows a good cold temperature change stability.

TABLE 9

Cold temperature change stability of the additized oil:

| Example | Additive: Comb polymer | Ethylene copolymer | Dosage | CFPP before storage | CFPP after storage: lower | Δ CFPP (lower) | middle | Δ CFPP (middle) | upper | Δ CFPP (upper) |
|---|---|---|---|---|---|---|---|---|---|---|
| 67 | 20% B13 | 80% A2 | 1500 ppm | −23° C. | −22° C. | −1 K | −22.5° C. | −0.5 K | −22° C. | −1 K |
| 68 | 20% B13 | 80% A4 | 1500 ppm | −22.5° C. | −22° C. | 0.5 K | −22.5° C. | 0 K | −22° C. | 0.5 K |
| 69 (C) | — | A4 | 2500 ppm | −20° C. | −12° C. | 8 K | −12.5° C. | 7.5 K | −14° C. | 6 K |

The CFPP values reported are mean values of a double determination

The invention claimed is:

1. An additive comprising the following components:

A) a copolymer of ethylene and 8–21 mol % of a comonomer of at least one acrylic or vinyl ester having a $C_1$–$C_{18}$-alkyl radical and B) a comb polymer of at least one $C_8$–$C_{16}$-alkyl ester of an ethylenically unsaturated dicarboxylic acid as monomer group 2 and at least one $C_{10}$–$C_{20}$-olefin as monomer group 1, wherein said comb polymer is characterized by a sum Q of from 23 to 27 according to the formula $$Q = \sum_i w_{1i} \cdot n_{1i} + \sum_j w_{2j} \cdot n_{2j}$$

where Q is the sum of the molar average of the carbon chain distributions in the alkyl side chains of monomer 1 and the molar average of the carbon chain distributions in the fatty alcohols in the ester groups of monomer 2, and $w_1$, and $w_2$ are the molar proportions of the individual chain lengths in the different monomer groups 1 and 2;

$n_1$, and $n_2$ are the side chain lengths, and i and j are the individual side chains in the particular monomer.

2. The additive as claimed in claim 1, wherein Q is from 24 to 26.

3. The additive as claimed in claim 1, wherein component A comprises ethylene and from 3.5 to 20 mol % of vinyl acetate and from 0.1 to 12 mol % of a compound selected from the group consisting of vinyl neononanoate, vinyl neodecanoate, vinyl2-ethylhexanoate, and mixtures thereof.

4. The additive of claim 1, wherein copolymer A comprises ethylene and from 8 to 18 mol % of vinyl esters, and from 0.5 to 10 mol % of olefins selected from the group consisting of propene, butene, isobutylene, hexene, 4-methylpentene, octene, diisobutylene, norbornene, and mixtures thereof.

5. The additive of claim 1, wherein the copolymer of component A has a molecular weight of between 3000 and 15 000 g/mol.

6. The additive of claim 1 wherein component A has degrees of branching of between 2 and 9 $CH_3$/100 $CH_2$ groups which do not stem from the comonomer.

7. The additive of claim 1 wherein the dicarboxylic acid is selected from the group consisting of maleic acid, fumaric acid, itaconic acid, and mixtures thereof.

8. The additive of claim 1, wherein the $C_{10}$–$C_{20}$-olefin comprises α-olefins.

9. The additive of claim 1, further comprising a constituent C which is a polymer or copolymer including ($C_{10}$–$C_{24}$-alkyl) acrylate units or methacrylate units and having a molecular weight of from 800 to 1 000 000 g/mol in an amount of up to 40% by weight, based on a total weight of A, B and C.

10. The additive of claim 1, further comprising a polar nitrogen-containing paraffin dispersant.

11. A fuel oil composition, comprising a fuel oil of animal or vegetable origin and the additive of claim 1.

12. A method for improving the cold flow properties of fuel oils of animal or vegetable origin comprising adding to said fuel oils the additive of claim 1.

13. A method for improving the cold flow properties of fuel oils which comprise mixtures of biofuels and middle distillates, said method comprising adding to said fuel oils the additive of claim 1.

14. The additive of claim 1, wherein copolymer A comprises ethylene and from 10 to 18 mol % of a comonomer of at least one vinyl ester.

15. The additive of claim 14, wherein the vinyl ester is vinyl acetate.

* * * * *